US005520337A

United States Patent [19]

Fuchs

[11] Patent Number: 5,520,337

[45] Date of Patent: May 28, 1996

[54] CONTROLLABLE DISCHARGE HEAD FOR CONTROLLING THE FLOW MEDIA DELIVERED THERETHROUGH

[75] Inventor: Karl-Heinz Fuchs, Radolfzell, Germany

[73] Assignee: Ing. Erich Pfeiffer GmbH & Co. KG, Germany

[21] Appl. No.: 379,076

[22] Filed: Jan. 26, 1995

Related U.S. Application Data

[63] Continuation of Ser. No. 930,402, Nov. 16, 1992, abandoned, filed as PCT/EP91/00456 published as WO91/13687.

[30] Foreign Application Priority Data

Mar. 14, 1990 [DE] Germany ..... 40 08 069.2

[51] Int. Cl.[6] ..... B05B 7/04; B05B 11/00

[52] U.S. Cl. ..... 239/427; 239/343; 239/370; 239/371; 239/372; 239/432

[58] Field of Search ..... 239/343, 369, 239/370, 371, 372, 427, 430, 432; 222/190

[56] References Cited

U.S. PATENT DOCUMENTS

| | | | |
|---|---|---|---|
| 2,348,839 | 5/1944 | Oldham | 239/432 x |
| 2,624,622 | 1/1953 | Holte . | |
| 2,796,297 | 6/1957 | Klock | 239/343 X |
| 3,388,868 | 6/1968 | Watson et al. | 239/432 X |
| 3,606,963 | 9/1971 | Marand . | |
| 3,704,814 | 12/1972 | Ruscitti . | |
| 4,042,217 | 8/1977 | Snider et al. . | |
| 4,147,306 | 4/1979 | Bennett | 239/372 X |
| 4,330,086 | 5/1982 | Nysted . | |
| 4,396,529 | 8/1983 | Price et al. . | |
| 4,509,689 | 4/1985 | Kuo | 239/430 X |
| 4,511,086 | 4/1985 | Kuo | 239/430 x |
| 4,511,087 | 4/1985 | Matsumoto | 239/430 X |
| 4,615,467 | 10/1986 | Grogan et al. | 239/343 x |
| 4,653,691 | 3/1987 | Grime . | |
| 4,708,292 | 11/1987 | Gammons . | |
| 4,738,398 | 4/1988 | Corsette | 239/432 X |
| 4,819,878 | 4/1989 | Bailey et al. | 239/430 X |
| 4,971,252 | 11/1990 | Tasaki et al. | 239/343 X |
| 5,048,750 | 9/1991 | Tobler | 239/343 X |
| 5,219,102 | 6/1993 | Wright | 222/190 |

FOREIGN PATENT DOCUMENTS

| | | |
|---|---|---|
| 0155024 | 2/1985 | European Pat. Off. . |
| 0243783 | 11/1987 | European Pat. Off. . |
| 0286925 | 10/1988 | European Pat. Off. . |
| 0336188 | 10/1989 | European Pat. Off. . |
| 0355316 | 8/1976 | Germany . |
| 1426553 | 3/1976 | United Kingdom . |
| 2168266 | 6/1986 | United Kingdom . |

*Primary Examiner*—Andres Kashnikow
*Attorney, Agent, or Firm*—Quarles & Brady

[57] ABSTRACT

A discharge head is connected to a double pump for air and liquid. The air and liquid are separately passed by pump actuation through a flow calming member and then into a combining member in a way such that the air enters in the form of numerous individual jets and under a low pressure and at a low flow rate into a liquid-wetted screen unit provided in a widened chamber. In the vicinity of the screen unit which are supplied with liquid from a chamber, the liquid can be foamed in a stepwise manner with the aid of air until the foam is discharged ready for use through an end channel.

36 Claims, 2 Drawing Sheets

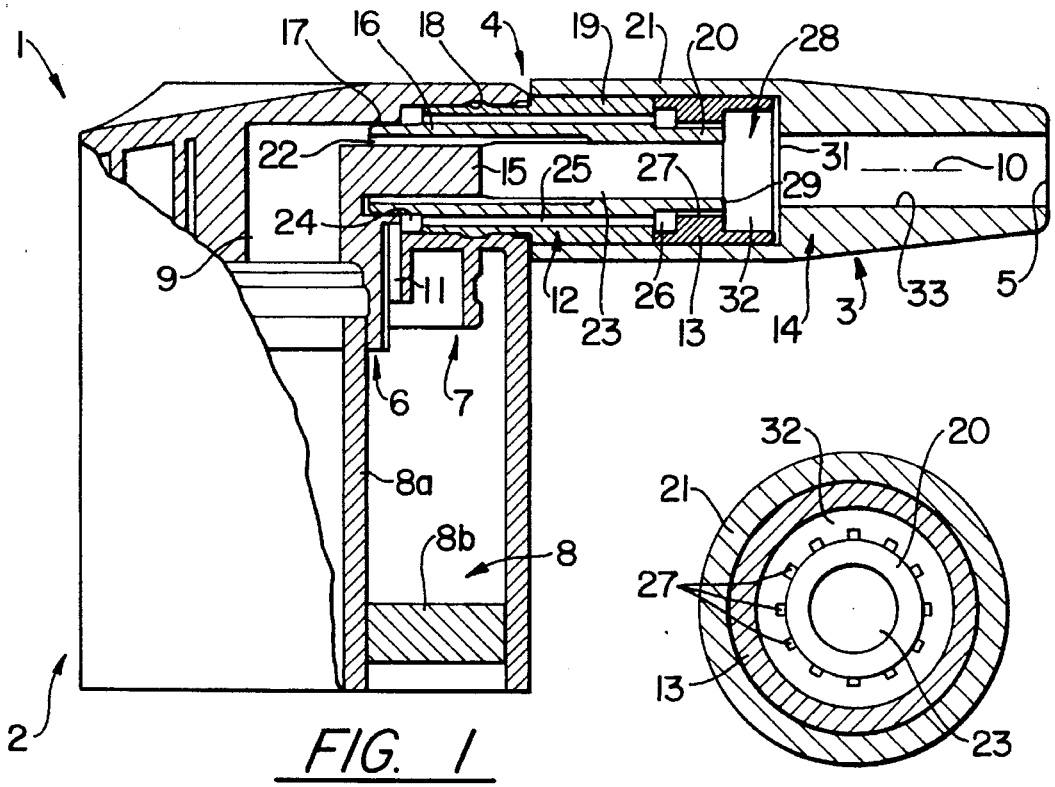
FIG. 1
FIG. 3
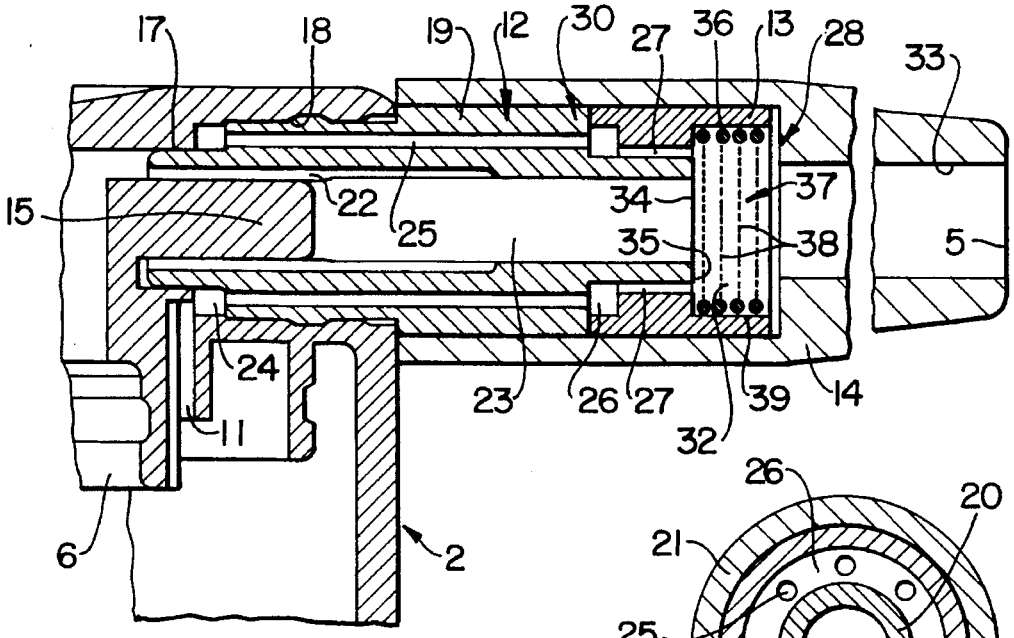
FIG. 2
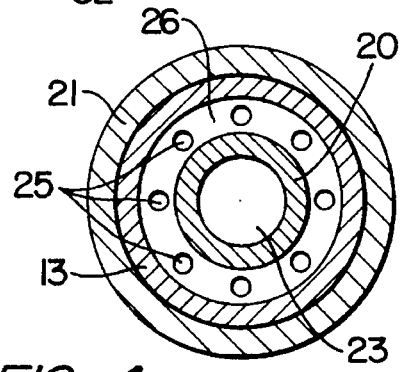
FIG. 4

CONTROLLABLE DISCHARGE HEAD FOR CONTROLLING THE FLOW MEDIA DELIVERED THERETHROUGH

This application is a continuation of U.S. application Ser. No. 07/930,402 filed Nov. 16, 1992, now abandoned, filed as PCT/EP91/00456 published as WO91/13687.

BACKGROUND OF THE INVENTION

The invention relates to a discharge head for media, which in particular has means for the precisely controlled flow influencing of at least one medium, so that it is possible to deliver said medium optionally by manually operated pumping within close tolerances of flow rate and/or volume per time unit.

In particular, the discharge head has means for bringing together or combining at least two separately supplied or stored media, which can have different components with the same and/or a different aggregate state and which chemically or physically, e.g., by mixing, cooperate with one another at the latest in the vicinity of the discharge from an outlet.

Preferably, the media, particularly a gaseous and a liquid medium must cooperate in such a way as to produce a foam or froth with precisely determinable characteristics, e.g., a very stable, very finely structured foam.

For foam production or for the intense, thorough mixing of media, use can be made of a manually operable discharge device with which the air and liquid are combined and then forced through a porous permeable body. Therefore, the discharge device can be suitable for, in particular, easily foamable, flowable media, e.g., for numerous uses.

U.S. Pat. No. 2,624,622 discloses a foaming gun, in which compressed air enters from an annular nozzle surrounding a liquid nozzle into a mixing chamber. It thereby draws liquid from a container and mixes therewith in the mixing chamber before being discharged through foaming screens out of the opening thereof.

SUMMARY OF THE INVENTION

In accordance with the invention there is provided a discharge head of the aforementioned type with which also relatively difficulty mixable or foamable media can be brought together in such a way that it is possible to achieve a very precise structure of the mixing, preferably a particularly homogeneous mixing.

According to the invention this problem is solved in that at least one medium undergoes flow calming before and in particular, immediately before, combination, e.g., in that the flow rate is suddenly reduced. Independently of this, also at least one medium can be brought together, in a plurality of separate flow jets, with at least one additional medium, the medium being appropriately exposed immediately prior to combination, and initially in an undivided volume flow, to flow calming, and is then subdivided into the individual flow jets.

Advantageously the combination of the media takes place immediately adjacent to or at least one permeable, flat body, such as a screen or sieve, which, in the manner of a sponge, at least at the intake side, can be so wetted or impregnated with the liquid medium that its through openings are covered with the liquid medium in the manner of liquid films. These openings can have a width of approximately 1/100 mm or less, e.g., half the latter. The screens can be stampings of a flat screen material made from plastic or the like and can be combined into a multilayer screen pack.

If two or more identical or stepped, fine-pored screen bodies are arranged in direct succession, then the thorough mixing takes place during passage in successive stages until the desired degree of mixing is achieved or the desired foam structure is obtained. Adjacent screen bodies can engage to be flush with one another, and/or can have a small gap spacing approximately corresponding to their thickness, e.g., of significantly less than 1 mm, so as to permit transverse flows and optionally transverse extensions of the forming foam between the intake side and the outlet side within the entire screen arrangement and along the screen surface. Where screens engage with one another, their screen openings, optionally in accordance with a probability distribution, are so reciprocally displaced that the opening separations of one screen cross the openings of the other screen.

For solution of problems addressed by the invention, it can also be advantageous for the media to be brought directly to the screen body at right angles to an intake side, and without prior combination, and only then and/or following the same, are they then combined within the screen body. Between the associated inlets of channels for media and the intake side of the screen body, there can be a gap spacing of the aforementioned order of magnitude.

Advantageously, all the inlets for at least two media associated with the combination are in a common surface or plane roughly at right angles to the flow direction, and to which is connected the screen body with a constant spacing or in a flat or flush engaging manner. The screen body side remote therefrom forms the outlet, so that upstream and downstream of the screen body are formed flow paths much longer than the latter, and which are directed roughly parallel and in an aligned manner.

Appropriately the gaseous medium is supplied through at least one ring of relatively small openings, which surrounds a single or several, much larger openings for the supply of the liquid medium, and which is very close to the outer circumference of the resulting central opening field. The combining chamber optionally having the screen body is appropriately wider than the screen body.

To the combining chamber or screen body is advantageously connected a reservoir for the liquid medium separated from the supply of the additional medium, and which in the vicinity of its end remote from the screen body has one or more relatively narrow supply openings, so that at the screen body there is always a large quantity of liquid medium available from which the screen body can draw by capillary action and from which the medium does not flow back of its own accord through the supply openings. The flow calming can take place in several successive stages, e.g., in axially succeeding, coaxial, identical and/or annular or widened chambers.

The ring chambers provided for the gaseous medium are interconnected by through, linear, parallel, longitudinal channels, whose width can be slightly larger and whose number is smaller than those of the connecting channels, which directly supply said medium to the combining chamber or screen body. The particular channel or chamber appropriately has a substantially constant cross-section over the entire length.

Particularly, in the case of foam production the inventive construction makes it possible to ensure that the air uniformly enters the screen chamber with a relatively low pressure and speed. The pressure and speed also remain substantially constant if the air is delivered with a pump, such as a thrust piston pump and this makes it possible to produce a very fine-pored and homogeneous foam. The fine screen body from an adequately effective closure for the liquid supply in the case of non-use, because with respect to the flow characteristics or viscosity of the liquid medium it is so constructed that said medium does not flow through the screen body under the force of weight only, so that there is an effective outflow protection.

BRIEF DESCRIPTION OF THE DRAWINGS

These and further features of preferred further developments of the invention can be gathered from the claims, description and drawings and the individual features, both singly and in the form of subcombinations, can be realized in an embodiment of the invention and in other fields and can represent advantageous, independently protectable constructions for which protection is hereby claimed. An embodiment of the invention is described in greater detail hereinafter relative to the drawings, wherein:

FIG. 1 is a sectional view of the discharge head of the invention.

FIG. 2 is a larger-scale detailed of FIG. 1.

FIG. 3 is a cross-sectional view through the combining chamber of the discharge head.

FIG. 4 is a cross-sectional view through a flow calming means of the discharge head.

DETAILED DISCUSSION

Figure 5:
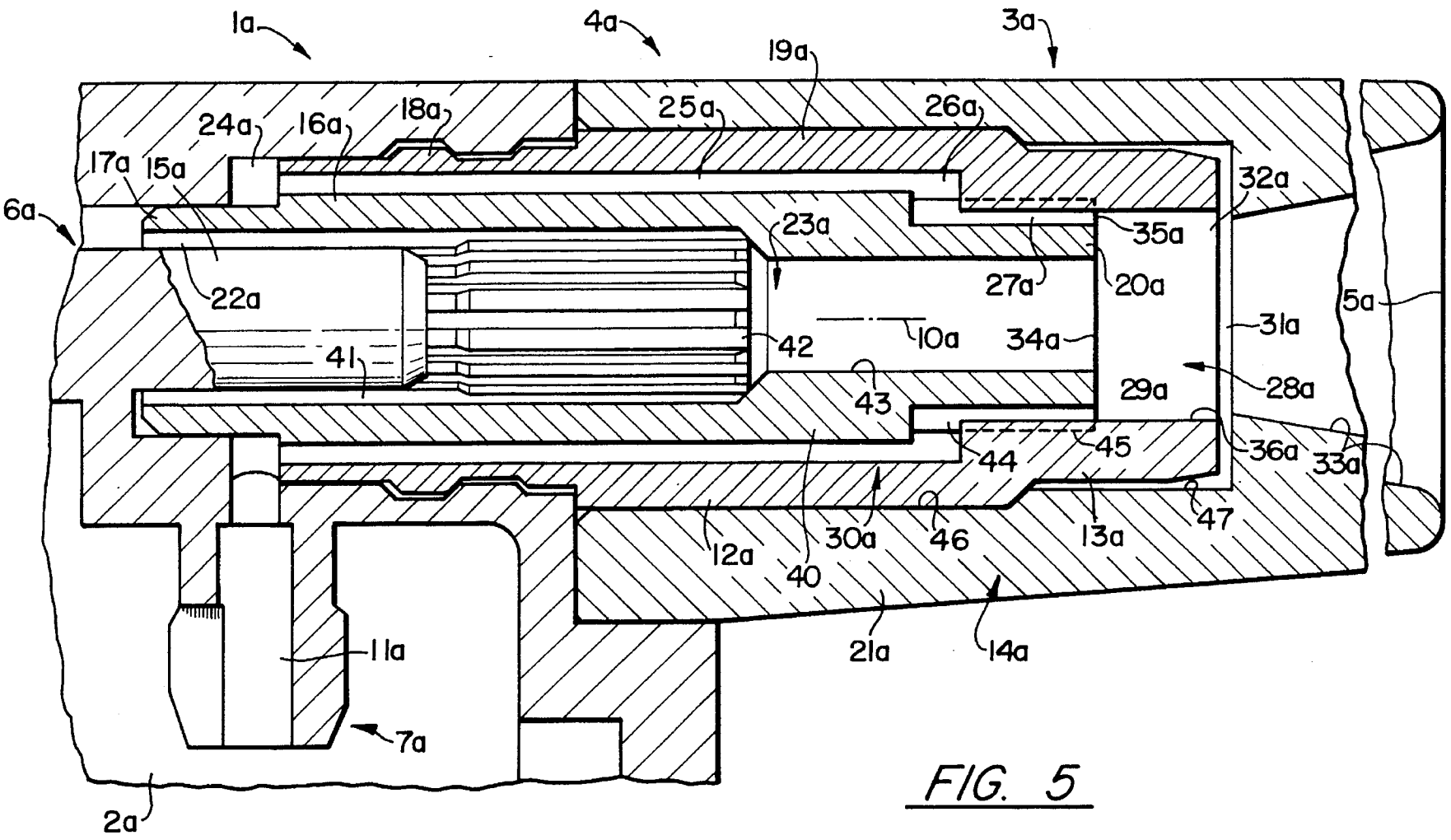
FIG. 5 is a view corresponding to the view of FIG. 2 of another embodiment of the invention.

The discharge head 1 is in particular suitable for use on a discharge apparatus according to that described in DE-OS 37 22 469, to which reference should be made for further details. The discharge head 1 has a cap-like basic body 2 to be fitted onto the piston shaft of a fluid pump of the discharge apparatus, and has a discharge connection 3 projecting approximately radially therefrom, and forms a pump actuating pressure handle with its cap end wall. Together with the basic body 2, the discharge connection 3 receives a foaming device for the separate supply, intermediate storage, flow calming and subsequent bringing together or combination, accompanied by production of foam, of a liquid medium and air. The discharge medium obtained passes as a foam stream out of an outlet 5 provided at the free end of the discharge connection 3.

For connection to a piston shaft 8a and an outlet channel provided therein the basic body 2 has a socket-like plug-in connection 6 projecting freely over the inside of its cap end wall. The connection 6 is surrounded by a plug-in connection 7 projecting in the same direction and located within the cap jacket for an air or pneumatic pump 8, whose cylinder is formed by the cap jacket, and which has an annular piston 8*b* sealingly traversed by the piston shaft 8*a* and fixed to the liquid pump casing. The connection 6 has an angular delivery channel 9 leading to the rear end of the discharge connection 3. A delivery channel 11 of the connection 7 annularly surrounding the connection 6 also leads within the basic body 2 into said rear end of the discharge connection 3. Between the delivery channels 9 and 11, and the outlet 5 there are flow paths with changing internal diameters which are substantially only linear or parallel or symmetrical to a central axis 10.

The discharge connection 3 is constructed as a closed subassembly inserted at its rear end in a corresponding flange area of the one-piece basic body 2, and to whose connection 7 can be fixed by a snap connection an outlet valve unit of the air pump 8 immediately adjacent to the associated pump chamber. The outlet connection 3 or the foaming device 4 comprises three interengaged sleeve parts, namely two inner sleeve parts 12 and 13, and an outer sleeve 14 forming the outlet 5. The sleeve part 12 with a fixing end 16 projecting over the rear end of the outer sleeve 14, and internally receiving a core 15, and having two diameter-reciprocally displaced portions 17 and 18, is used for plug or snap connection to the flange part of the basic body 2.

A connecting, slightly widened portion 19 is located within a reception sleeve 21 formed by the rear end of the outer sleeve 14 with a constant internal circumference connected by means of a ring shoulder to an end channel.

The portion 19 passes through an approximately planar ring shoulder into a much smaller external diameter end portion 20, on which is engaged the longer sleeve portion 13. The sleeve portions 12 and 13 can form a subassembly with a constant external diameter in the vicinity of the portion 19, and the sleeve portion 13 can be inserted with tension into the reception sleeve 21.

The core 15 which is constructed in one piece with the connection 6 engages from the rear end of the sleeve part 12 into the central bore of the latter, which has a constant width over roughly its entire length. Between the outer circumference of the core 15 and the inner circumference of said bore, longitudinal channels 22 are provided in a uniformly circumferentially distributed manner as longitudinal grooves, and extend over and beyond the front end of the core 15, and having their rear ends connected by means of an annular clearance to the delivery channel 9. Between the front ends of the mandrel-like core 15 and the sleeve portion 12, the interior of sleeve portion 12 forms a through, constantly wide, elongated chamber 23.

The air delivery channel 11 is connected to the rear end of a chamber 24 located upstream of the annular clearance for the supply channels 22 and annularly surrounds the same, and is bounded at its front face from the rear end of the portion 18 and at its inner circumference from the portion 17. From the front face of the chamber 24 emanates a ring of connecting channels 25 uniformly arranged around the central axis 10, which extend up to the front ring shoulder of the portion 19 and are located in bore-like manner completely within the jacket of the sleeve portion 12. To the front ends of the connecting channels 25 is connected another annular chamber 26, which is correspondingly bounded on the one hand by the portions 19 and 20, and on the other by the sleeve portion 13, which can be larger than the chamber 24 and also has roughly square cross-section.

To the front end wall of the chamber 26 is connected a plurality of connecting channels 27, which are narrower and much shorter than the connecting channels 25 and are arranged in a ring around the chambers 23. The connecting channels 27 are formed by longitudinal grooves on the inner circumference of the sleeve part 13 and are bounded by the outer circumference of the end portion 20 and have, like the connecting channels 25, a constant width over their length. They extend up to the bottom end wall 29 of a chamber provided as a combining means 28 for the media. The end wall 29 is formed by the front end face of the sleeve portion 12 and an inner ring face of a widened inner portion of the sleeve part 13 located in its plane. As a result of the described channel arrangement a flow calming means 30 for the supplied air is formed directly upstream of the combining chamber 28 and which, like the liquid, is substantially only axially guided, entered and exited.

In the chamber 32 of the combining means 28, whose width is greater than all the remaining, inlet-side connected channels, the liquid is so foamed or frothed with the air, that the foam passes from the frontally facing outlet 31 into an approximately constantly wide, elongated end channel 33, whose front end forms the outlet 5, and in which the foam can be completely stabilized. The end channel 33 which is slightly wider than the chamber 23 is narrower than the chamber 32.

While all the remaining channels and chambers are completely free from projecting parts and the like, and are smooth-walled throughout, the chamber 32 is substantially completely filled with a screen unit 37, having very finely meshed or microporous screens 38 at right angles to the flow direction which succeed one another with uniform, limited spacings with respect to the central axis 10, and which engage with their circumferential edges 39 in the inner circumference 36 of the chamber 32. The liquid and air inlets 34 and 35 formed by the ends of the chambers 23 and the connecting channels 27 are located in a radial spacing within the inner circumference 36 directly adjacent to the face of the first screen 38, and substantially with the same spacings with respect thereto. These screens 38 and the chambers 32 further reduce and calm the air flow, which passes through the screen pores accompanied by the entrainment of the liquid, so that between adjacent screens 38, foaming can commence or take place and the resulting foam can be forced as a result of the volume increase through the additional screens 38. The foam is then slightly compressed in the vicinity of the narrower outlet 31. The length of the chamber 32 can be smaller than its width, so that in the represented case four screens 38 succeed one another. The chamber 32 can be supplied with additional liquid from the chamber 23 at any time.

The air outlet of the air pump 8 can be valve-free or can have a valve which is not pretensioned, in the manner of an overpressure valve, with a freely movable valve body, so that the flow rate and the pressure of the delivered air are controllable substantially solely by the manually exerted operating pressure. For the discharge of specific liquids the air outlet of the pump can also be provided with an overpressure valve. The same applies with regards to an outlet valve for the liquid pump, which is used for refilling the chamber 23 simultaneously with the delivery of air. The chamber 23 is also used for flow calming, so that both the air and the liquid can be supplied with a limited pressure and low flow rate to the combining means 28.

In FIG. 5 corresponding parts are given the same reference numerals as in the remaining drawings, but are followed by the letter "a", so that all the description parts appropriately apply to all the embodiments. Random features or constructions in the embodiments can be provided in random combination or in an additive manner in further embodiments.

According to FIG. 5 the chambers 24*a*, 26*a* and 32*a*, and the channels 25*a* and 27*a* are formed by two sleeve portions 12*a* and 14*a*, which interengage over most of their length. As a result the connecting channels 25*a*, in much the same way as described relative to the channels 27, can be bounded on one longitudinal side by the outer circumference of the inner sleeve portion 40 and on all remaining longitudinal sides by a groove in the inner circumference of the outer sleeve portion 12*a*. The bottom of this groove forms the associated, radially outer boundary of the chamber 26*a*, whose lateral flanks, much as for the chamber 24*a*, are formed by two facing ring shoulders on the one hand of sleeve portion 40 and on the other of sleeve portion 12*a*.

The ring shoulder of the outer sleeve portion 12*a*, further forwards in the flow direction, passes into a channel portion, which has roughly the same internal diameter as the inner circumference 36*a*, and is constant from said ring shoulder to the outlet 31*a*. The front end of the sleeve portion 40 engages in the rear part of the inner channel in such a way that only the connecting channels 27*a* remain free. For this purpose the front end portion 20*a* of the sleeve portion 40 has a reduced external diameter compared with the portion connected to the rear ring shoulder of the chamber 26*a*, and is provided in a circumferentially distributed manner with longitudinal webs 44, which engage in corresponding longitudinal grooves on the inner circumference of the inner channel by plugging in. The longitudinal grooves 45 can end at the front end 29*a* of the sleeve portion 40 or at the front ends of the webs 44, and therefore approximately at the rear end of the chamber 32*a*, or can be longer or can extend up to the outlet 31*a*.

Not only the rear fixing end 16*a* of the sleeve portion 40, but also the rear end 18*a* of the sleeve portion 12*a* is fixed by engagement or pressing in corresponding bores of the basic body 2*a*. Only the rear fixing end 18*a* of the sleeve portion 12*a* is axially secured with respect to the basic body 2*a* by a snap connection, whereas the inner sleeve portion 40 is secured against forward movement by its front end abutting on the sleeve portion 12*a*.

The chamber 23*a* has a rear channel portion 42 and a narrower, front channel portion 43, which passes in a smooth-walled manner up to the inlet 34*a*. In the vicinity of the core 15*a*, the supply channels 22*a* form channel portions 41, which are bounded in a circumferentially closed manner in cross-section. The bore receiving the core 15*a* extends with constant internal diameter over the front end of the core 15*a* by an amount which is smaller than its width. This bore then passes into the slightly wider portion 42, which is connected by means of an annular, conical shoulder to the rear end of the channel portion 43, and is longer than its internal diameter. The channel portion 43 which is longer than the same is narrower than the bore receiving the core 15*a*. The base faces of the grooves forming the channel portions 41 pass through continuously up to the conical ring shoulder, but the groove depth is correspondingly smaller due to the widening of the channel portion 42 in the vicinity thereof. Therefore the liquid can pass out of the inlet 34*a* as an envelope flow, which has formed on the inner circumference of the channel portion 43. The air passes out of the inlets 35*a* in a corresponding envelope flow formed by the individual longitudinal flows.

The external diameter of the front end 13*a* of the sleeve portion 12*a* is reduced and is located in a substantially contact-free manner in a front bore portion 47 of the outer sleeve 14*a*, which passes through an inner ring shoulder into the rear end of the end channel 33*a*. The bore portion 47 passes rearwards via a ring shoulder into a slightly wider bore portion 46, in which the wider portion of the sleeve portion 12*a* engages in fixed, stop-limited manner. Both the rear end of the outer sleeve 14*a* and also a rear ring shoulder of the sleeve portion 12*a* strike against a common ring shoulder of the basic body 2*a*, the rear end of the outer sleeve 14*a* appropriately engaging in a depression on the outer circumference of the basic body 2*a*.

The end channel 33 or 33*a* is used for the finished development and stabilization of the foam and is therefore smooth-walled and free from edges or abrupt width changes. According to FIG. 5 the end channel 33*a* is widened in an acute-angled manner from the rear end to the outlet 5*a* and its length is greater than its average width. Thus, on its path through the end channel 33, the foam can slightly radially expand and assume an even finer structure. In the vicinity of the outlet 5*a* the front edge of the end channel 33*a* is convexly rounded in cross-section, so that at this location, the foam is also not abruptly freed from its circumferential boundary.

The delivery channel 11*a* of the connection 7*a* if formed by a tubular connection, onto which is snapped a valve casing of an outlet valve of the air pump and can consequently be secured. Therefore, the valve or the associated valve seat is directly adjacent to the chamber 24*a* into which radially issues the delivery channel 11*a*.

The sleeve parts 12*a*, 40 and the outer sleeve 14*a* can be combined in pairs or all in a random manner to provide a preassembled unit. The sleeve portion 40 can be preassembled before the sleeve portion 12*a*, and the outer sleeve 14*a* assembled on the basic body 2*a*, and then the sleeve portion 12*a* and outer sleeve 14*a* can be successively fitted or fitted as a subassembly, which leads to a very simple installation.

I claim:

1. A dispenser head (1) for manually discharging media, including at least a first medium and a second medium, said head (1, 1*a*) comprising:

an outlet (5, 5*a*) for expelling at least said first medium and said second medium;

a gathering zone (28, 28*a*) for initially bringing at least said first medium and second medium together;

first duct means for passing said first medium into said gathering zone (28) in a manner substantially separate from the second medium; and second duct means for passing said second medium into said gathering zone (28) in a manner substantially separate from the first medium;

said first and second duct means each configured for defining the flow characteristics of the respective ones of said first medium and said second medium in a predetermined manner for each; and abatement means (23, 23*a*, 30, 30*a*) for retarding the flow of at least one of said first medium and said second medium at a location directly upstream of said gathering zone (28) in a retarding step, said abatement means (23) including a downstream abatement end, and said gathering zone (28) including issuing inlets (34, 35) for said first and second medium, said issuing inlets (34, 35) being provided in an inlet face (29), said downstream abatement end being provided at said inlet face (29).

2. The dispenser head according to claim 1, wherein:

said first and second duct means are separate to a location substantially up to said gathering zone (28), said first duct means having a final first issuing section at said gathering zone (28) and said second duct means having a final second issuing section at said gathering zone (28);

said first issuing section having a first supply inlet (22) for passing said first medium thereinto and a first issuing outlet (34) for passing said first medium into said gathering zone (28);

said second issuing section having a second supply inlet (26) for passing said second medium thereinto and a second issuing outlet (35) for passing said second medium into said gathering zone (28);

each of said first and second issuing sections, said first and second supply inlets (22, 26) and said first and second issuing outlets (34, 35) shaped to define a cross-sectional passage width extension and a length extension for controlling the flow velocity of said first medium and said second medium respectively therethrough;

said abatement means including first abatement means (23) provided for retarding said flow velocity of said first medium directly upstream of said gathering zone (28) and shaped for suddenly retarding said flow velocity in said final first issuing section providing said first abatement means (23);

said passage width extension of said final first issuing section being substantially larger than said passage width extension of said first supply inlet (22), thereby said final first issuing section being provided by an enlarged abatement passage including said first issuing outlet (34); and said first issuing section (23) defining a passage abatement width extension and an abatement length extension, said abatement width extension being substantially constant over said abatement length extension, said abatement width extension being defined by a bore channel and substantially directly connecting to said gathering zone (28), thereby a downstream end of said bore channel defining said first issuing outlet (34).

3. The dispenser according to claim 2, wherein said first issuing section is of oblong shape, said passage width extension of said first issuing section being substantially constant over said length extension of said first issuing section, said gathering zone (28) being provided by a gathering chamber (32), said inlet face providing a bottom face (29) of said gathering chamber (32).

4. The dispenser head according to claim 3, wherein said dispenser head (1) is constructed for defining an operative state and an initial non-operative state, said first issuing section associated with a capillary closure (37) permeable to the first medium which is closed in the non-operative state for providing protection against outflow of said first medium, said first issuing section including a reservoir chamber from which the first medium is drawable into said gathering zone (28) by capillary suction action through said capillary closure (37) located inside said gathering chamber (32).

5. The dispenser head according to claim 4, wherein said passage width extension of said first supply inlet (22) is sufficiently small for preventing the first medium from flowing back out of said reservoir chamber of said first issuing section through said first supply inlet (22).

6. The dispenser head according to claim 2, wherein said gathering zone (28) is provided by a gathering chamber (32) and further comprises mixing means for mixing at least said first medium and said second medium, said mixing means being permeable to said first medium and further including at least one of:

throttle means;

porous structure; and said first and second issuing outlet (34, 35) separately issuing directly at said mixing means at the most by a gap distance of below 1 mm, with said mixing means located for permitting the media to transversely flow and extend along said mixing means provided in and along said gathering chamber (32) defining said gathering zone (28).

7. The dispenser head according to claim 1, wherein said dispenser head (1) is constructed for defining operative and non-operative states, said gathering zone (28) including a gathering chamber (32) and a porous structure (37) permeable to the media, said porous structure (37) having an inlet side and passage openings for said first medium, and further comprising means for impregnating said porous structure (37) with said first medium and for covering said passage openings at least at said inlet side, when in said non-operative state, with said first medium said gathering chamber (32) being bounded by said inlet face (29) and facingly having a chamber outlet (31), said gathering chamber (32) being substantially entirely filled with said porous structure (37).

8. The dispenser head according to claim 1, wherein a porous structure (37) permeable to at least one of said first medium and said second medium is provided, said porous structure (37) including a plurality of microporous sieves (38) making up a multilayer sieve pack, and said sieves (38) being spaced adjacent to each other, one of said sieves (38) having a thickness extension, with said adjacent sieves (38) being reciprocally spaced by a distance substantially corresponding to said thickness extension.

9. The dispenser head according to claim 1, wherein said gathering zone (28) includes porous structure (37) permeable to at least one of said first medium and said second medium, said porous structure including interspaced adjacent sieves (38) and sieve surfaces, said adjacent sieves (38) being reciprocally spaced by a distance of substantially less than 1 mm, and means being provided for permitting at least one of said first medium and said second medium to operationally transversely flow and extend along said sieve surfaces within said porous structure (37).

10. The dispenser head according to claim 2, wherein said final first issuing section including said first issuing outlet (34) and said first supply inlet further comprise means for expelling said first medium out of said first issuing outlet as an envelope flow, said first medium being a liquid.

11. The dispenser head according to claim 10, further comprising means for subdividing said envelope flow into single flow jets at said first issuing outlet, said means for subdividing including said first supply inlet as a plurality of supply inlets located at a distance upstream from said first issuing outlet (34*a*).

12. The dispenser head according to claim 1, wherein said first and second duct means further comprise first and second issuing sections including first and second issuing outlets (34, 35) for passing the first medium and the second medium respectively at a location directly upstream of and into said gathering zone (28) substantially in a common plane, said first and second issuing outlets located at the ends of said first and second issuing sections and each defining first and second passage width extensions for the first medium and second medium respectively, said first passage width extension of said first issuing outlet (34) being larger than said second passage width extension of said second issuing outlet (35) by a multiple, said inlet face (29) being an end face, said first and second issuing outlets (34, 35) being provided for letting the first and second medium into said gathering zone (28) substantially only in an axial flow direction, said dispenser head (1) including a discharge stud (3) having a free stud and a rear stud end, said free stud end providing said outlet (5) and said rear stud end (16) connecting to first and second feed ducts (9, 10) for feeding the first and second medium respectively to said gathering zone (28), between said feed ducts (9, 11) and said outlet (5), said first and second duct means defining first and second flow paths, said first and second flow paths being substantially exclusively linear.

13. The dispenser head according to claim 1, wherein said first duct means has a first issuing outlet (34) issuing into said gathering zone (28) within said second duct means, said second duct means having a plurality of second issuing outlets (35) distributed around said first issuing outlet (34), and issuing into said gathering zone (28), said gathering zone (28) having a gathering chamber (32) bounded by a bottom face (29) and an inner circumference (36), and said second issuing outlets (35) being reciprocally separate and radially inwardly spaced from said inner circumference (36), connecting ducts (27) being provided and including duct ends (35), said duct ends providing said second issuing outlets (35), said connecting ducts (27) defining passage width extensions and a length extension, said passage width extension being constant over said length extension, said gathering zone (28) including porous structure (37) to be passed by the first and second medium, said first and second issuing outlets (34, 35) directly connecting to said porous structure (38).

14. The dispenser head according to claim 1, further comprising means (8) provided for positively forcing the second medium through said gathering zone (28), said dispenser head (1) providing a base body (2) and a discharge stud (3) substantially radially projecting from said base body (2) and including a free stud end, said free stud end including said outlet (5), said base body (2) including a shaft connector (6) for connecting said base body (2) to a piston shaft of a first pump provided for pumping the first medium, within said base body (2) said shaft connector (6) providing a first feed duct (9) for feeding the first medium to said gathering zone (28), said first feed duct (9) being angular and connecting to a rear stud end of said discharge stud (3), said stud connector (6) being surrounded by a second feet duct (11) for feeding the second medium to said gathering zone (28), said second feed duct (11) also connecting to said rear stud end (16).

15. The dispenser head according to claim 1, wherein separate outer and inner sleeve members (12*a*, 40*a*) are provided for bounding said first and second duct means, said gathering zone (28*a*) including a chamber (32*a*) bounded by said inlet face (29*a*) and an inner chamber circumference (36*a*), said inner sleeve member (40) providing said inlet face (29) and bounding said first duct means by an inner sleeve circumference (43), said outer sleeve member (12*a*) providing said chamber circumference (36*a*) and bounding said second duct means and said inner sleeve member (4) defining said abatement means (23), said discharge head (1) including a base body (2) and a discharge stud (3) having a free stud end and a rear stud end (16), said free stud end providing said outlet (5) and said rear stud end (16) providing a stud connector (6) fastening said discharge stud (3) to said base body (2), said discharge stud (3) providing a preassembled sub-assembly inserted in said base body (2), said sub-assembly including said abatement means (23) and said gathering zone (28), said base body (2) internally providing a shaft connector (6) for connecting said dispenser head (1) to a piston shaft and to an outlet duct provided within the piston shaft.

16. The dispenser head according to claim 15, wherein said outer and inner sleeve members (12*a*, 40) have interengaging inner and outer circumferences commonly bounding said second duct means, and include at least one abating chamber (24*a*, 26*a*) for retarding the flow characteristics of the second medium, said base body (2) including a pump cylinder of a piston pump (8) for pumping said second medium.

17. The dispenser head according to claim 15, further comprising a core body (15, 15*a*) located in said inner sleeve member (40), said inner sleeve member having a forward sleeve end face (29*a*), said core body (15, 15*a*) having an outer core circumference and a forward core end face, said core circumference bounding said first duct means (22*a*) upstream of said abatement means (23, 23*a*), from said core end face to said sleeve end face (29*a*), said first duct means providing an abatement chamber of said abatement means, and said abatement chamber directly issuing into said gathering zone (28).

18. The dispenser head according to claim 1, wherein said first medium is a liquid and said second medium is gaseous, and said gathering zone (28, 28*a*) further comprises and provides the foam forming means (37) for mixing the first and second medium to provide a composite foam medium, said outlet (5) being provided at a free end of a discharge stud (3) having a rear end (16), said rear end (16) connecting to first and second feed ducts (9, 11) for feeding the first and second medium to said gathering zone (28), between said feed ducts (9, 11) and said outlet (15) said first and second duct means defining first and second flow paths oriented substantially exclusively linear.

19. The dispenser head according to claim 1, wherein said abatement means (23, 23*a*, 30, 30*a*) comprises means (23, 23*a*) for retarding the flow of said first medium comprised of a pourable medium, said outlet (5) being provided at a free end of a discharge stud (3) having a rear end (16), said rear end (16) connecting to first and second feed ducts (9, 11) for feeding the first and second medium to said gathering zone (28), between said feed ducts (9, 11) and said outlet (15) said first and second duct means defining first and second flow paths oriented substantially exclusively linear.

20. The dispenser head according to claim 19, wherein:

said first and second duct means are separate to a location substantially up to said gathering zone (28), said first duct means having a final first issuing section at said gathering zone (28) and said second duct means having a final second issuing section at said gathering zone (28);

said first issuing section having a first supply inlet (22) for passing said first medium thereinto and a first issuing outlet (34) for passing said first medium therefrom, said second issuing section having a second supply inlet (26) for passing said second medium thereinto and a second issuing outlet (35) for passing said second medium therefrom;

each of said first and second duct sections, said first and second supply inlets (22, 26) and said first and second issuing outlets (34, 35) shaped to define a cross-sectional passage width extension and a length extension for controlling the flow velocity of said first medium and said second medium respectively therethrough;

said abatement means (23) being provided for retarding said flow velocity of said first medium directly upstream of said gathering zone (28) and shaped for suddenly retarding said flow velocity in said first issuing section;

said passage width extension of said first issuing section being substantially larger than said passage width extension of said first supply inlet (22); and said first issuing outlet (34) being made up of an end of said first issuing section (23), said dispenser head (1) including a base body (2) and a discharge stud (3) projecting from said base body (2) with a free and providing the outlet (5), said base body (2) providing a shaft connector (6, 7) for connecting said discharge head (1) to a piston shaft of a pump for pumping said pourable medium, to an outlet duct of the pump and to a pump for pumping the second medium.

21. The dispenser head according to claim 20, wherein said first issuing section including said first issuing outlet (34) is of oblong shape, said passage width extension of said first issuing section being substantially constant over said length extension of said first issuing section, said first issuing section providing said abatement means (23) for abating flow of the first medium with respect to flow in said first supply inlet (22), said first issuing outlet (34) directly connecting to said gathering zone (28).

22. The dispenser head according to claim 20, wherein said dispenser head (1) is constructed for defining an operative state and an initial non-operative state, said first issuing section associated with a capillary closure (37) permeable to the first medium which is closed in the non-operative state for providing protection against outflow of said first medium, said first issuing section including a reservoir chamber from which the first medium is drawable into said gathering zone (28) by capillary suction action through said capillary closure (37), said gathering zone (28) being provided by a gathering chamber (32), said inlet face providing a bottom face (29) of said gathering chamber (32), said capillary closure (37) being located inside said gathering chamber (32).

23. The dispenser head according to claim 22, wherein said passage width extension of said first supply inlet (22) is sufficiently small for preventing the first medium from flowing back out of said reservoir chamber of said first issuing section through said first supply inlet (22).

24. The dispenser head according to claim 20, wherein said gathering zone (28) further comprises mixing means for mixing at least said first medium and said second medium, said mixing means further including at least one of:

throttle means;

porous structure permeable to the media; and said first and second issuing outlet (34, 35) separately issuing directly at said mixing means at the most by a gap distance of below 1 mm, with said mixing means located for permitting the media to transversely flow and extend along said mixing means provided in a mixing chamber (32) defining said gathering zone (28).

25. The dispenser head according to claim 19, wherein said dispenser head (1) is constructed for defining operative and non-operative states, said gathering zone (28) including a gathering chamber (32) and a porous structure (37) permeable to said first and second media, said porous structure (37) having an inlet side and passage openings for said first medium, and further comprising means for impregnating said porous structure (37) with said first medium and for covering said passage openings at least at said inlet side, when in said non-operative state, with said first medium said gathering chamber (32) being bounded by said inlet face (29) and facingly having a chamber outlet (31), said gathering chamber (32) being substantially entirely filled with said porous structure (37).

26. The dispenser head according to claim 19, wherein a porous structure (37) permeable to at least one of said first medium and said second medium is provided, said porous structure (37) including a plurality of microporous sieves (38) making up a multilayer sieve pack, and said sieves (38) being adjacent each other, one of said sieves (38) having a thickness extension, with said adjacent sieves (38) being reciprocally spaced by a distance substantially corresponding to said thickness extension.

27. The dispenser head according to claim 19, wherein said gathering zone (28) includes porous structure (37) permeable to at least one of said first medium and said second medium, said porous structure including interspaced adjacent sieves (38) and sieve surfaces, said adjacent sieves (38) being reciprocally spaced by a distance of substantially less than 1 mm, and means being provided for permitting at least one of said first medium and said second medium to operationally transversely flow and extend along said sieve surfaces within said porous structure (37).

28. The dispenser head according to claim 20, wherein said first issuing section and said first supply inlet further comprise means for expelling said first medium out of said first issuing outlet as an envelope flow.

29. The dispenser head according to claim 28, further comprising means for subdividing said envelope flow into single flow jets at said first issuing outlet, said means for subdividing including said first supply inlet as a plurality of supply inlets located at a distance upstream from said first issuing outlet (34*a*).

30. The dispenser head according to claim 19, wherein said first and second duct means further comprise first and second issuing sections including first and second issuing outlets (34, 35) for passing first medium and second medium respectively at a location directly upstream of and into said gathering zone (28) substantially in a common plane, said first and second issuing outlets located at the ends of said first and second issuing sections and each defining first and second passage width extensions for the first medium and second medium respectively, said first passage width extension of said first issuing outlet (34) being larger than said second passage width extension of said second issuing outlet (35) by a multiple, said inlet face (29) being an end face, said first and second issuing outlets (34, 35) being provided for letting the first and second medium into said gathering zone (28) substantially only in an axial flow direction, said dispenser head (1) including a discharge stud (3) having a free stud and a rear stud end, said free stud end providing said outlet (5) and said rear stud end (16) connecting to first and second feed ducts (9, 10) for feeding the first and second medium respectively to said gathering zone (28), between said feed ducts (9, 11) and said outlet (5), said first and second duct means defining first and second flow paths, said first and second flow paths being substantially exclusively linear.

31. The dispenser head according to claim 19, wherein said first duct means has a first issuing outlet (34) issuing into said gathering zone (28) within said second duct means, said second duct means having a plurality of second issuing outlets (35) distributed around said first issuing outlet (34), and issuing into said gathering zone (28), said gathering zone (28) having a gathering chamber (32) bounded by a bottom face (29) and an inner circumference (36), and said second issuing outlets (35) being reciprocally separate and radially inwardly spaced from said inner circumference (36), said dispenser head (1) including a base body (2) and a discharge stud (3) projecting to a free and including said outlet (5), said base body (2) including a shaft connector (6, 7) for connecting said dispenser head (1) to a piston shaft of a first pump provided for pumping the pourable medium to said gathering zone (28), said shaft connector (6, 7) including first and second feed ducts (9, 11) for connecting said first and second duct means with said first pump and a second pump (8) provided for pumping the second medium to said gathering zone (28), said first duct means (9) connecting to a rear end (16) of said discharge stud (3), between said first and second feed ducts (9, 11) and said outlet (5) said first and second duct means defining first and second flow paths oriented substantially exclusively linear and parallel.

32. The dispenser head according to claim 19, further comprising means (8) provided for positively forcing the second medium through said gathering zone (28) via a pump chamber (8) provided by said dispenser head (1).

33. The dispenser head according to claim 19, wherein separate outer and inner sleeve members (12*a*, 40*a*) are provided for bounding said first and second duct means, said gathering zone (28*a*) including a chamber (32*a*) bounded by said inlet face (29*a*) and an inner chamber circumference (36*a*), said inner sleeve member (40) providing said inlet face (29) and bounding said first duct means by an inner sleeve circumference (43), said outer sleeve member (12*a*) providing said chamber circumference (36*a*) and bounding said second duct means and said inner sleeve member (4), defining said abatement means (23), said discharge head (1) including a base body (2) and a discharge stud (3) having a free stud end and a rear stud end (16), said free stud end providing said outlet (5) and said rear stud end (16) providing a stud connector (6) fastening said discharge stud (3) to said base body (2), said discharge stud (3) providing a preassembled sub-assembly inserted in said base body (2), said sub-assembly including said abatement means (23) and said gathering zone (28), said base body (2) internally providing a shaft connector (6) for connecting said dispenser head (1) to a piston shaft and to an outlet duct provided within the piston shaft.

34. The dispenser head according to claim 33, wherein said outer and inner sleeve members (12*a*, 40) have interengaging inner and outer circumferences commonly bounding said second duct means, and include at least one abating chamber (24*a*, 26*a*) for retarding the flow characteristics of the second medium, said base body (2) including a pump cylinder of a piston pump (8) for pumping said second medium.

35. The dispenser head according to claim 33, further comprising a core body (15, 15*a*) located in said inner sleeve member (40), said inner sleeve member having a forward sleeve end face (29*a*), said core body (15, 15*a*) having an outer core circumference and a forward core end face, said core circumference bounding said first duct means (22*a*) upstream of said abatement means (23, 23*a*), from said core end face to said sleeve end face (29*a*), said first duct means providing an abatement chamber of said abatement means, and said abatement chamber directly issuing into said gathering zone (28).

36. The dispenser head according to claim 19, wherein said first medium is a liquid and said second medium is gaseous, and said gathering zone (28, 28*a*) further comprises and provides the foam forming means (37) for mixing the first and second medium to provide a composite foam medium, said outlet (5) being provided at a free end of a discharge stud (3) having a rear end (16), said read end (16) connecting to first and second feed ducts (9, 11) for feeding the first and second medium to said gathering zone (28), between said feed ducts (9,11) and said outlet (15) said first and second duct means defining first and second flow paths oriented substantially exclusively linear.

* * * * *